US006822155B2

(12) United States Patent
Konishi

(10) Patent No.: US 6,822,155 B2
(45) Date of Patent: Nov. 23, 2004

(54) KEY TO SWITCH FOR ELECTRONIC MUSICAL INSTRUMENT

(75) Inventor: Keiji Konishi, Hamamatsu (JP)

(73) Assignee: Kabushiki Kaisha Kawai Gakki Seisakusho, Shizuoka-ken (JP)

( * ) Notice: Subject to any disclaimer, the term of this patent is extended or adjusted under 35 U.S.C. 154(b) by 0 days.

(21) Appl. No.: 10/353,029

(22) Filed: Jan. 29, 2003

(65) Prior Publication Data

US 2003/0154848 A1 Aug. 21, 2003

(30) Foreign Application Priority Data

Feb. 21, 2002 (JP) ..... 2002-045375
Feb. 21, 2002 (JP) ..... 2002-045376

(51) Int. Cl.[7] ..... G10H 1/34
(52) U.S. Cl. ..... 84/720
(58) Field of Search ..... 84/719, 720, 745

(56) References Cited

U.S. PATENT DOCUMENTS 4,653,375 A * 3/1987 Honda et al. ..... 84/637

* cited by examiner

*Primary Examiner*—Jeffrey W Donels
(74) *Attorney, Agent, or Firm*—Crowell & Moring LLP

(57) ABSTRACT

A key top switch for an electronic musical instrument which can be manufactured at a low cost is provided for preventing noise due to bouncing between an operation panel and a key top, and permitting accurate and easy positioning of the key top at a predetermined position in the longitudinal direction and horizontal direction of the operation panel. The key top switch is disposed in an operation panel of an electronic musical instrument. The key top switch comprises a switch board attached on a back side of the operation panel, and a key top sandwiched between the operation panel and the switch board. The key top includes a contact member in contact with the switch board, and a resilient arm for urging the contact member toward the switch board.

5 Claims, 5 Drawing Sheets

KEY TO SWITCH FOR ELECTRONIC MUSICAL INSTRUMENT

BACKGROUND OF THE INVENTION

1. Field of the Invention

The present invention relates to a key top switch for an electronic musical instrument such as an electronic piano, which is disposed in an operation panel of the electronic musical instrument as a versatile switch.

2. Description of the Prior Art

FIG. 1 illustrates an example of a conventional key top switch for an electronic piano equipped with a speaker (not shown). The key top switch 51 is disposed in an operation panel 52, for example, as a tone selection switch. The key top switch 51 comprises a switch board 53 made of a printed wiring board; and a large number of key tops 54 supported on the switch board 53. Each of the key tops 54, implemented by a molding made of synthetic resin, has a support 55 attached on the switch board 53; and a body 57 supported by the support 55 through a hinge 56. The support 55 has a top surface adhered to the back surface of the operation panel 52 with a double-sided adhesive tape 58. A pair of contacts 59 are formed on the surface of the switch board 53 and the lower surface of the body 57, respectively, such that they oppose each other.

As a player presses the body 57 of a key top 54 constructed as described above, the pair of contacts 59 are brought into contact to turn ON the key top 54. Responsively, the switch board 53 outputs an ON signal to a controller (not shown) to control the tone of the electronic piano. The top surface of the support 55 of the key top 54 adhered to the back surface of the operation panel 52 with the double-sided adhesive tape 58 prevents bouncing caused by relative vibrations between the operation panel 52 and key top 54 produced by acoustic vibrations generated from the speaker to limit noise.

FIG. 2 illustrates another example of a conventional key top switch for an electronic piano. The key top switch 60 is disposed in an operation panel 61, for example, as a tone selection switch, as is the case with the key top switch 51. The operation panel 61, made of an extrudate, comprises a large number of key top holes 62 extending therethrough in the vertical direction; and ribs 63, each of which protrudes at a predetermined position on the back side of the operation panel 61 and extending in the horizontal direction. The key top switch 60 comprises a switch board 64 in a similar structure to the switch board 53; and a large number of key tops 65 supported on the switch board 64 and slightly protruding from the key top holes 62 of the operation panel 61 associated therewith. Each of the key tops 65, which is a molding made of synthetic resin or the like, comprises a support 66 fitted on the rib 63 and attached to the switch board 64; and a body 67 supported by the support 66. The key top 65 is attached to the operation panel 61 with the support 66 fitted on the rib 63 of the operation panel 61, to position the key top 65 relative to the operation panel 61 at a predetermined position in the longitudinal direction. The key top 65 is positioned in the horizontal direction by adhering the top surface of the support 66 to the back surface of the operation panel 61 with a double-sided adhesive tape 58, while determining a position at which the key top 65 is attached through a visual check or the like, such that the center of the body 67 is aligned with the center of the key top hole 62.

Though not shown, the key top 65 is provided with a pair of positioning collapse sections protruding in the longitudinal direction at predetermined positions of the rib 63 in the horizontal direction for positioning of the key top 65 in the horizontal direction. The support 66 of the key top 65 is inserted between the positioning collapse sections to carry out the positioning. The positioning collapse sections are formed by pressing the rib 63 using a dedicated pressing die previously provided therefor.

However, in the conventional key top switch 51 illustrated in FIG. 1, the support 55 of the key top 54 must be adhered to the operation panel 52 using the double-sided adhesive tape 58 for preventing the key top 54 from bouncing. Since such a complicated operation must be performed for each of a large number of key tops 54, the key top switch 51 suffers from an increased manufacturing cost.

The conventional key top switch 60 illustrated in FIG. 2, in turn, implies the following problems. When the key top 65 is positioned relative to the operation panel 61 in the horizontal direction using the double-sided adhesive tape 58, each of a large number of key tops 65 must be adhered while determining a position at which the key top 65 is attached. This adhering operation is very complicated, causing an increase in the manufacturing cost of the key top switch 60. Also, since the human's vision is relied on to determine the position at which the key top 65 is attached, the position cannot be accurately determined in some cases. Even if the position is accurately determined, it is difficult to precisely adhere the key top 65 at that position, thereby failing to provide a high accuracy for the attachment and a uniform quality.

On the other hand, when the key top 65 is positioned in the horizontal direction using the positioning collapse sections formed on the rib 63 of the operation panel 61, it is technically difficult to form the positioning collapse sections with a high accuracy through pressing. In addition, the aforementioned pressing die is required for forming the positioning collapse sections. However, the fabrication of such an expensive pressing die only for purposes of positioning causes a large costly burden and a resulting increase in the manufacturing cost of the key top switch.

SUMMARY OF THE INVENTION

The present invention has been made to solve the problems as mentioned above, and it is an object of the invention to provide a key top switch for an electronic musical instrument which is capable of preventing noise due to bouncing between an operation panel and a key top, and permitting accurate and easy positioning of the key top at a predetermined position in the longitudinal direction and horizontal direction of the operation panel, and can be manufactured at a low cost.

To achieve the above object, according to a first aspect of the present invention, there is provided a key top switch for an electronic musical instrument disposed in an operation panel thereof, which is characterized by comprising a switch board attached on a back side of the operation panel; and a key top sandwiched between the operation panel and the switch board, and including a contact member in contact with the switch board, and a resilient arm for urging the contact member toward the switch board.

In this key top switch for an electronic musical instrument, the key top is sandwiched between the operation panel and the back side of the switch board, and the contact member of the key top is in contact with the switch board, and urged by the resilient arm of the key top toward the switch board. Since the key top is pressed against the switch board through the urged contact member at all times, the key top is prevented from vibrating with respect to the operation panel due to acoustic vibrations generated from a speaker. Consequently, it is possible to prevent bouncing between the key top and operation panel and noise caused thereby. Thus, unlike the conventional key top switch, the attachment of the key top to the operation panel can be simplified by omitting the adhesion of the key top with a double-sided adhesive tape for preventing noise, thereby reducing the manufacturing cost of the key top switch.

According to a second aspect of the present invention, there is provided a key top switch for an electronic musical instrument disposed in an operation panel thereof. The operation panel has a rib protruding on a back side thereof and tapered toward its leading end. The key top switch is characterized by comprising a switch board attached on the back side of the operation panel; and a key top sandwiched between the operation panel and the switch board, and including a contact member which is in engagement with the rib and is in contact with the switch board.

According to this key top switch for an electronic musical instrument, the key top is sandwiched between the operation panel and the switch board, and the contact member of the key top is in contact with the switch board, and is in engagement with the rib. Since this rib protrudes on the back side of the operation panel and is tapered toward its leading end, a force acts on the contact member engaging with the rib thus formed to come off the rib. Since the key top is pressed against the switch board through the contact member at all times by this action, the key top is prevented from vibrating with respect to the operation panel due to acoustic vibrations generated from a speaker. Consequently, it is possible to prevent bouncing between the key top and operation panel and noise caused thereby, as is the case with the first aspect. In addition, the manufacturing cost of the key top switch can be reduced by omitting the adhesion of the key top with a double-sided adhesive tape for preventing noise.

Preferably, in the key top switch for an electronic musical instrument, the key top further comprises a resilient arm for urging the contact member toward the switch board.

According to this preferred embodiment of the key top switch, since the contact member of the key top is in contact with the switch board with an urging force acting thereon from the resilient arm, in addition to the pressing force from the rib, it is possible to more securely prevent the bouncing between the operation panel and key top and noise caused thereby.

According to a third aspect of the present invention, there is provided a key top switch for an electronic musical instrument disposed in an operation panel thereof. The operation panel has a rib formed at a predetermined position in a longitudinal direction on the back of the operation panel for positioning in the longitudinal direction. The key top switch is characterized by comprising a key top having a first and a second engagement member, and attached on the operation panel with the first engagement member in engagement to the rib; and a switch board having an engagement member at a predetermined position in a horizontal direction for positioning in the horizontal direction, and fixed to the operation panel with the engagement member in engagement to the second engagement member of the key top.

According to this key top switch for an electronic musical instrument, the key top is attached on the operation panel with its first engagement member in engagement to the rib for positioning in the longitudinal direction. Since the rib for positioning is disposed at a predetermined position in the longitudinal direction of the operation panel, the key top can be accurately and readily positioned at a predetermined position in the longitudinal direction of the operation panel. The switch board is fixed on the operation panel with its engagement member for positioning in the horizontal direction in engagement to the second engagement member of the key top. Since this engagement member for positioning is disposed at a predetermined position in the horizontal direction of the switch board, the key top can be accurately and readily positioned at a predetermined position in the horizontal direction of the operation panel through the switch board. As a result, unlike the conventional key top switch, the attachment of the key top to the operation panel can be simplified by eliminating the adhesion of the key top with a double-sided adhesive tape for positioning in the horizontal direction, and the collapsing of a rib for forming positioning collapse sections, thereby reducing the manufacturing cost of the key top switch.

DETAILED DESCRIPTION OF THE PREFERRED EMBODIMENTS

Figure 1:
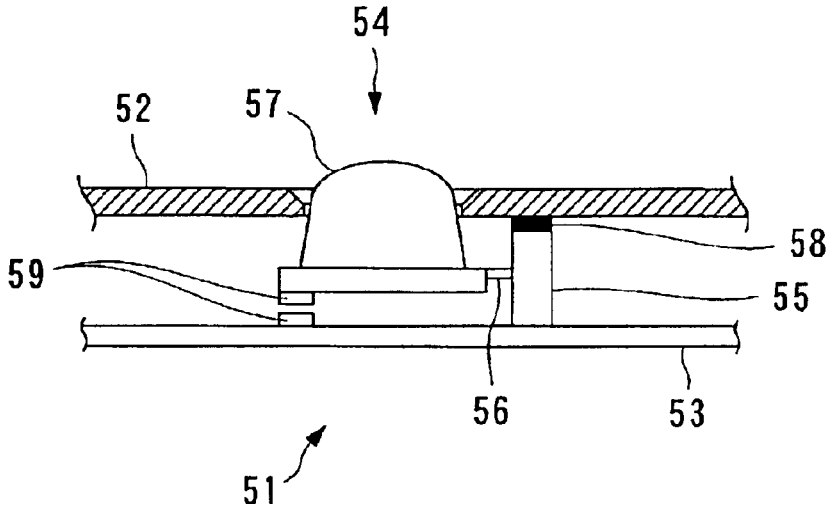
FIG. 1 PRIOR ART
FIG. 1 is a partial front view of a conventional key top switch and an operation panel of an electronic piano equipped with a speaker.
Figure 2:
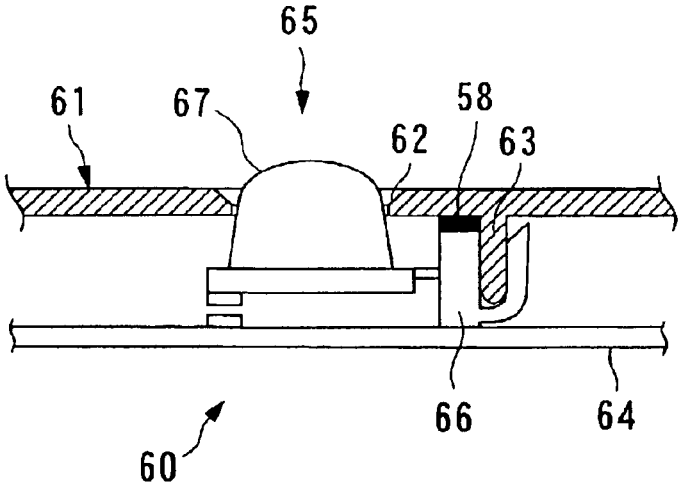
FIG. 2 PRIOR ART
FIG. 2 is a partial front view of a conventional key top switch for an electronic piano and an operation panel formed with a rib.
Figure 3:
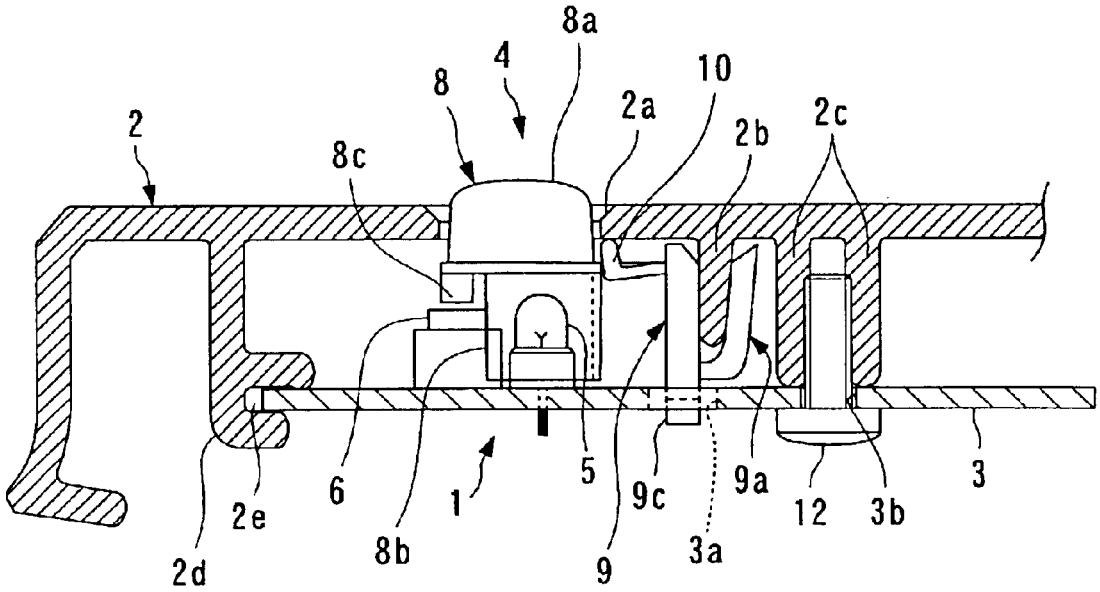
FIG. 3 is a partial front view of a key top switch for an electronic musical instrument according to a first embodiment of the present invention and an operation panel.

In the following, preferred embodiments of the present invention will be described in detail with reference to the accompanying drawings. FIG. 3 illustrates a key top switch for an electronic piano which applies the present invention. The key top switch 1 is disposed in an operation panel 2, for example, as a tone selection switch, and is operated to select a tone or a function such as automatic accompaniment, with such a selection being displayed thereon. The key top switch 1 comprises a switch board 3; a large number of key tops 4 (only one of which is shown in FIG. 3) attached on the operation panel 2; and a LED 5 for illuminating each key top 4.

Figure 4:
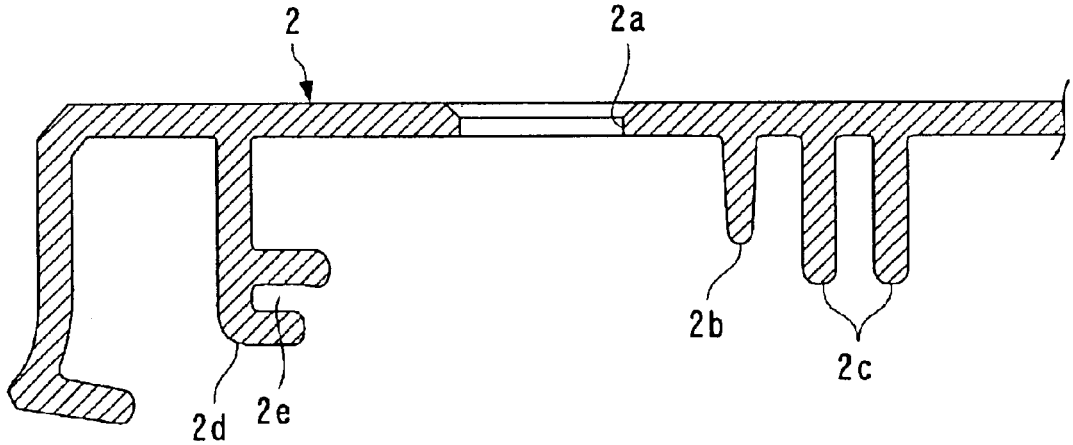
FIG. 4 is a partial front view of the operation panel.

The operation panel 2, comprised of an extrudate made of aluminum, is formed in a predetermined cross-sectional shape. As illustrated in FIG. 4, the operation panel 2 is formed with a large number of openings 2*a* (only one of which is shown) arranged side by side at predetermined positions and extending vertically through the operation panel 2. Each key top 4 has a body 8 slightly loosely fitted in each opening 2*a* and slightly extending upward of the operation panel 2. A rib 2*b* is formed at a predetermined position behind (on the left side in FIG. 4) the opening 2*a* of the operation panel 2 for positioning the associated key top 4 in the longitudinal direction. The rib 2*b* extends continuously in the horizontal direction, protrudes on the back side, and is tapered such that it has a smaller width toward the leading end. Just behind the rib 2*b*, a pair of screw receptacles 2*c*, extending in parallel in the horizontal direction, protrude on the back side of the operation panel 2. Further, in front of the opening 2*a* of the operation panel 2, a board support 2*d* extends in the horizontal direction and protrudes on the back side. The board support 2*d* is formed with a recess 2*e* open to the rear.

Figure 5:
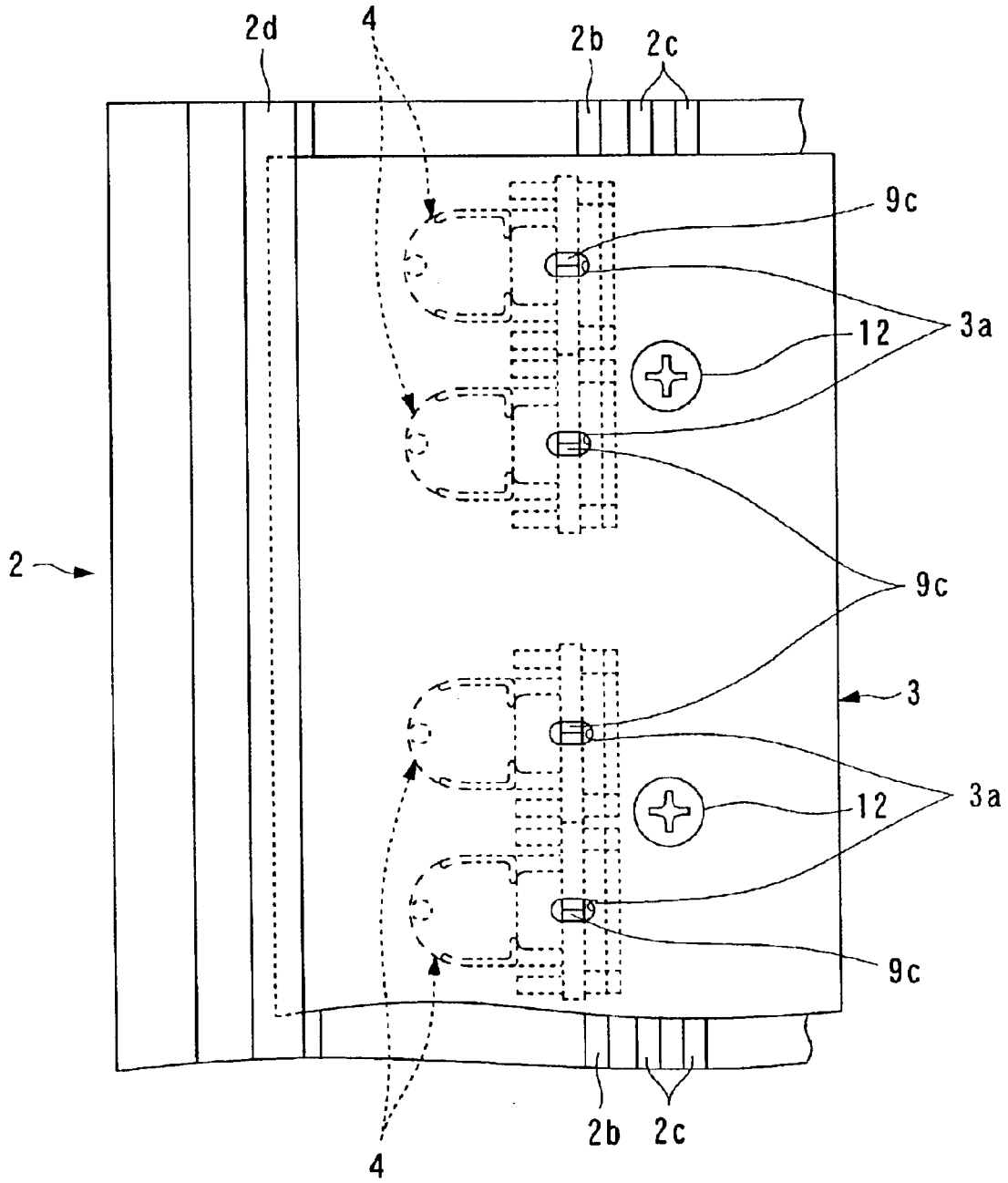
FIG. 5 is a partial bottom view of FIG. 3.

The switch board 3, made of a printed wiring board, comprises a tact switch 6 at a position corresponding to each key top 4. As the key top 4 is pressed, the tact switch 6 is turned On to turn the key top 4 ON. An ON signal is output to a controller (not shown) to select a tone or a function corresponding to the key top 4. At predetermined positions behind the tact switches 6, a large number of key top positioning holes 3*a* (engagement member) are formed for positioning the respective key tops 4 in the horizontal direction (see FIG. 5). Further, a plurality of attachment holes 3*b* are formed at intervals in the horizontal direction behind the key top positioning holes 3*a*. On the top surface of the switch board 3, the LED 5 is attached at a position below the body 8 of the key top 4. The LED 5 is connected to the controller which turns ON the LED 5 associated with a pressed key top 4 to display a selected tone or function.

Figure 6:
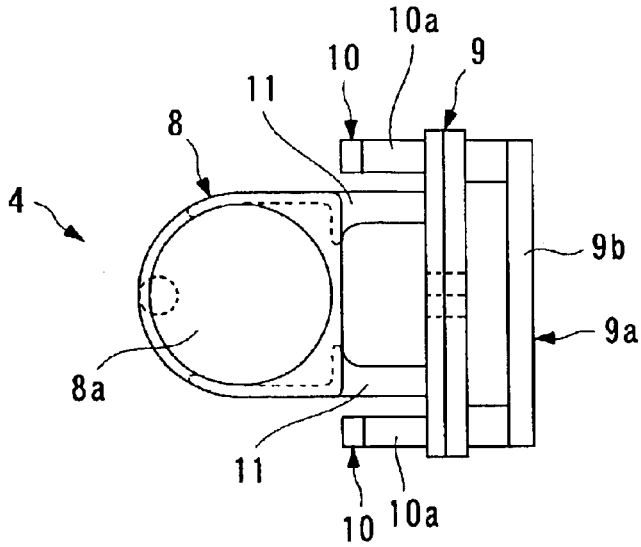
FIG. 6 is a plan view of the key top.
Figure 7:
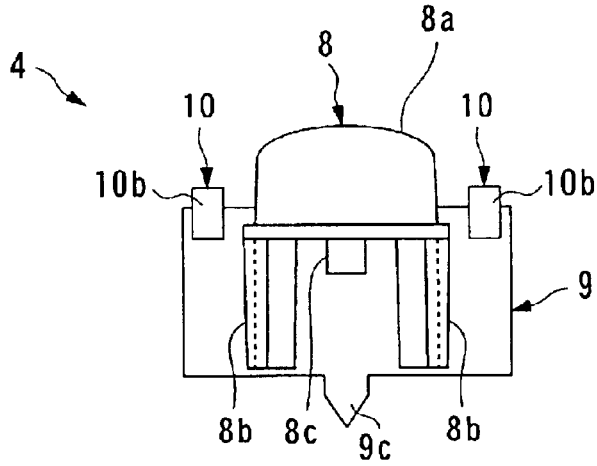
FIG. 7 is a side view of the key top.
Figure 8:
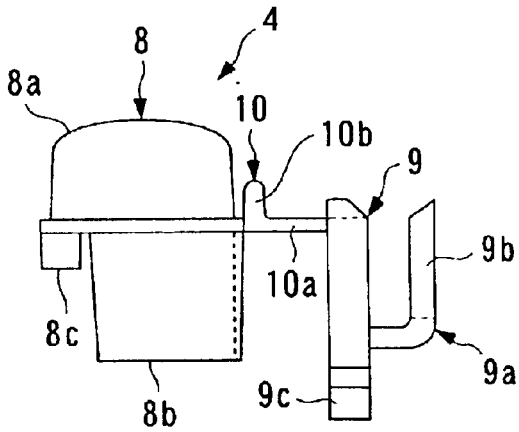
FIG. 8 is a front view of the key top.

As illustrated in FIGS. 6 to 8, each of the key tops 4 comprises the body 8 fitted into the opening 2*a* of the operation panel 2; and a contact member 9 which is in contact with the switch board 3 and supports the body 8 thereon.

The body 8 comprises an upper cylindrical cap 8*a* which is pressed for actuating the key top 4; and a lower cylindrical cover 8*b* which covers the LED 5. The cap 8*a* is made of translucent or transparent synthetic resin, for example, acrylic, while the rest of the key top 4 is made of translucent synthetic resin, for example, ABS, so that the key top 4 is formed, for example, in coinjection molding. At the leading end of the cap 8*a*, an actuator 8*c* protrudes downward, opposing the tact switch 6 of the switch board 3. The actuator 8*c* presses the tact switch 6 in response to the pressed key top 4 for actuation. The contact member 9 is coupled to the body 8 through a pair of left and right hinges 11. The key top 4 returns to the original position by the resiliency of the hinges 11 when it is released from a pressed state. The contact member 9 has an engagement member 9*a* (first engagement member) having an inverted L-shaped cross section and protruding from the back of the contact member 9. The engagement member 9*a* has a vertical section 9*b* which extends in the vertical direction substantially in parallel with the contact member 9. The contact member 9 is also formed with a positioning tab 9*c* (second engagement member) at the center of the lower surface of the contact member 9 in the horizontal direction. The positioning tab 9*c* has a predetermined width which is set to precisely fit into the key top positioning hole 3*a*.

The contact member 9 is further provided with a pair of left and right resilient arms 10 in upper end portions for urging the contact member 9 toward the switch board 3. Each of the resilient arms 10 is formed in an L-shaped cross section, and comprised of a relatively thin horizontal section 10*a* extending substantially horizontally from the front of the contact member 9, and a panel contact 10*b* extending upward from the leading end of the horizontal section 10*a*. Before the key top 4 is attached to the operation panel 2, the upper end of the panel contact 10*b* is positioned higher than the upper end of the contact member 9.

The key top switch 1 constructed as described above is assembled in the following manner. First, with the engagement member 9*a* of the contact member 9 of each key top 4 held in engagement to the rib 2*b* of the operation panel 2, the body 8 of the key top 4 is fitted into the associated opening 2*a* of the operation panel 2. The engagement member 9*a* engaged to the rib 2*b* permits the key top 4 to be accurately and readily positioned at a predetermined position in the longitudinal direction of the operation panel 2, and the body 8 fitted into the opening 2*a* roughly positions the key top 4 in the horizontal direction. Next, the leading end of the switch board 3 is inserted into the recess 2*e* of the operation panel 2, and the positioning tab 9*c* of each key top 4 is brought into engagement to the associated key top positioning hole 3*a* of the switch board 3. With this state maintained, a jig (not shown) is used to position the switch board 3 relative to the operation panel 2 at a predetermined position in the horizontal direction, and to screw a screw 12 between the screw receptacles 2*c* of the operation panel 2 through the attachment hole 3*b* to fix the switch board 3. In this way, a large number of key tops 4 can be accurately and readily positioned at a stretch at predetermined positions of the operation panel 2 in the horizontal direction. Thus, unlike the conventional key top switch, the attachment of the key tops to the operation panel can be simplified by omitting the adhesion of the key tops with a double-sided adhesive tape for positioning in the horizontal direction, and the collapsing of the rib for forming the positioning collapse sections, thereby reducing the manufacturing cost of the key top switch.

When the key top switch 1 is assembled, the panel contacts 10*b* of the resilient arms 10 come into contact with the operation panel 2, causing the horizontal section 10*a* to bend due to counterforces of the resilient arms 10 to urge the contact member 9 toward the switch board 3. The urged contact member 9 holds the key top 4 pressed against the switch board 3 at all times after the attachment. Similarly, when the key top switch 1 is assembled, the engagement member 9*a* of the contact member 9 is opened up by the tapered rib 2*b* of the operation panel 2, so that a force acts on the key top 4 to come off the rib 2*b*. Thus, this action holds the key top 4 pressed against the switch board 3 at all times after the attachment. In the foregoing manner, the contact member 9 of he key top 4 is in contact with the switch board 3 with the urging force from the resilient arms 10 and the pressing force from the rib 2*b* applied thereto, so that the key top 4 is securely attached to the operation panel 2. As a result, the key top 4 is free from vibrations with respect to the operation panel 2 due to acoustic vibrations generated from the speaker (not shown), thereby making it possible to prevent the bouncing between the key top 4 and operation panel 2, and noise caused thereby.

Figure 9:
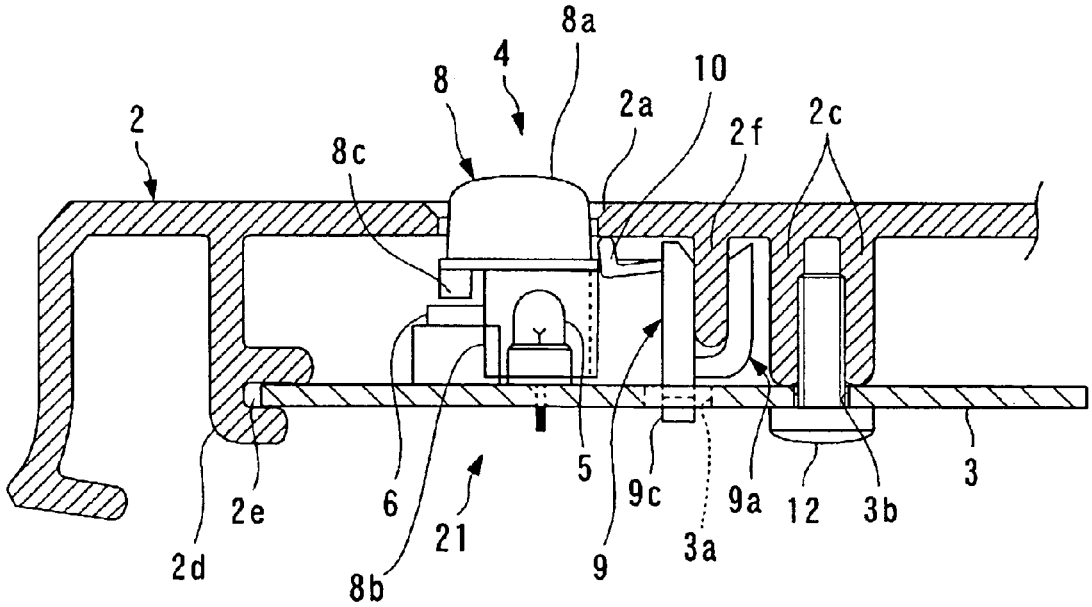
FIG. 9 is a partial front view of a key top switch for an electronic musical instrument according to a second embodiment of the present invention and an operation panel.

FIG. 9 illustrates a key top switch for an electronic piano according to a second embodiment of the present invention. As illustrated in FIG. 9, the key top switch 21 of the second embodiment is similar to the key top switch 1 of the first embodiment in the basic structure, except that a rib 2*f* of the operation panel 2 is not tapered but is coextensive. In FIG. 9, components identical to those in the first embodiment are designated the same reference numerals.

Therefore, in the second embodiment, the key top 4 is also held pressed against the switch board 3 at all times by an urging force of the resilient arms 10 formed on the contact member 9 which is in contact with the switch board 3, in a manner similar to the first embodiment. Consequently, the second embodiment can also provide the foregoing advantageous effects offered by the first embodiment.

Figure 10:
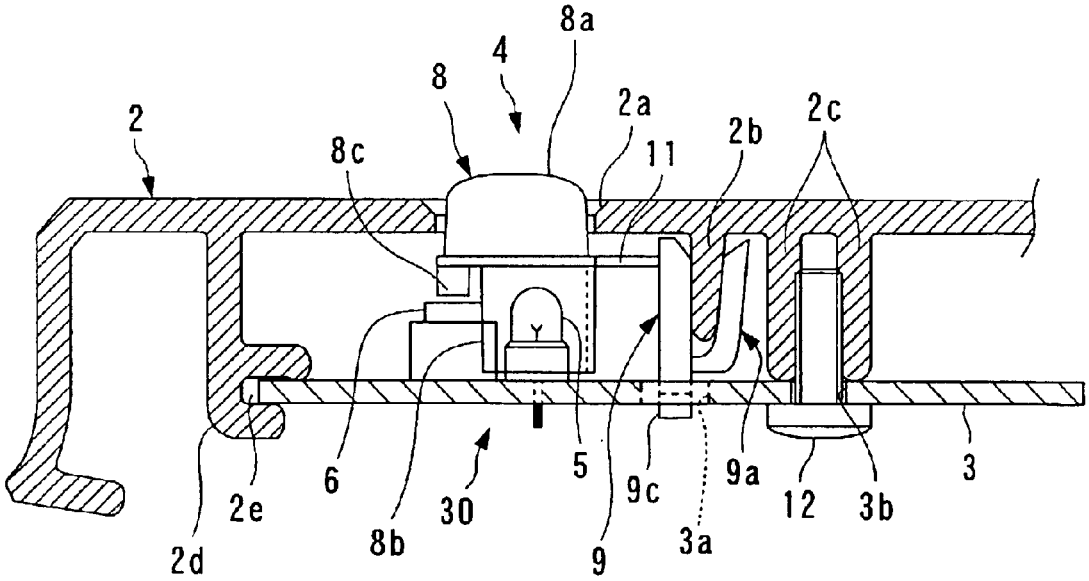
FIG. 10 is a partial front view of a key top switch for an electronic musical instrument according to a third embodiment of the present invention and an operation panel.

FIG. 10 illustrates a key top switch for an electronic piano according to a third embodiment of the present invention. As illustrated in FIG. 10, the key top switch 30 of the third embodiment is similar to the key top switch 1 of the first embodiment in the basic structure, except that the resilient arms 10 are omitted. In FIG. 10, components identical to those in the first embodiment are designated the same reference numerals.

Therefore, in the third embodiment, the tapered rib 2*b* of the operation panel 2 causes a force to act on the contact member 9 to come off the rib 2*b*, thereby holding the key top 4 pressed against the switch board 3 at all times. Consequently, the third embodiment can also provide the foregoing advantageous effects offered by the first embodiment.

It should be understood that the present invention is not limited to the foregoing embodiments but may be practiced in a variety of manners. For example, in the foregoing embodiments, the key top is positioned in the horizontal direction by engaging the positioning tab 9*c* of the key top 4 to the key top positioning hole 3*a* of the switch board 3, where the engagement relationship may be reversed. Specifically, the switch board may be formed with a protrusion at a predetermined position, and the key top may be formed with a recess for engagement to the protrusion. Also, while the rib 2*b* is continuous in the horizontal direction because the operation panel 2 is made of an extrudate, the rib 2*b* may be provided only at positions of the operation panel 2 at which the key tops are attached. In addition, while the present invention is applied to an electronic piano in the foregoing embodiments, the present invention may be applied to other electronic musical instruments, for example, an electronic organ and the like. Otherwise, the present invention can be modified as appropriate in its details without departing from the spirit and scope of the invention defined by the appended claims.

As described above, the key top switch for an electronic musical instrument according to the present invention can advantageously prevent noise due to bouncing between the operation panel and key tops. The key tops can be accurately and readily positioned at predetermined positions of the operation panel in the longitudinal and horizontal directions. In addition, the key top switch can be manufactured at a low cost.

What is claimed is:

1. A key top switch for an electronic musical instrument disposed in an operation panel thereof, said operation panel having a rib protruding on a back side thereof and tapered toward a leading end, said key top switch comprising:

a switch board attached on the back side of said operation panel; and a key top sandwiched between said operation panel and said switch board, said key top including a contact member which is in engagement with said rib and is in contact with said switch board.

2. A key top switch for an electronic musical instrument according to claim 1 wherein said key top further comprises a resilient arm for urging said contact member toward said switch board.

3. A key top switch for an electronic musical instrument disposed in an operation panel thereof, said operation panel having a rib formed at a predetermined position in a longitudinal direction on the back of said operation panel for positioning in the longitudinal direction, said key top switch comprising:

a key top having a first and a second engagement member, said key top attached on said operation panel with said first engagement member in engagement to said rib; and a switch board having an engagement member at a predetermined position in a horizontal direction for positioning in the horizontal direction, said switch board fixed to said operation panel with said engagement member in engagement to said second engagement member of said key top.

4. A key top switch for an electronic musical instrument disposed in an operation panel thereof, comprising:

a switch board attached on a back side of said operation panel; and a key top sandwiched between said operation panel and said switch board, said key top including a contact member in contact with said switch board, and a resilient arm disposed between said key top and said contact member and adapted to urge said contact member toward said switch board.

5. A key top switch for an electronic musical instrument according to claim 4, wherein said contact member has an upper surface and a lower surface, said lower surface being in contact with said switch board, and said upper surface not being adhered to the back surface of the operation panel.

* * * * *